US012570914B2

(12) United States Patent
Reid et al.

(10) Patent No.: US 12,570,914 B2
(45) Date of Patent: Mar. 10, 2026

(54) FUEL COMPOSITION COMPRISING DETERGENT AND QUATERNARY AMMONIUM SALT ADDITIVE

(71) Applicant: Innospec Limited, Ellesmere Port (GB)

(72) Inventors: Jacqueline Reid, Cymau (GB); Vincent Burgess, Ellesmere Port (GB)

(73) Assignee: Innospec Limited, Ellesmere Port (GB)

( * ) Notice: Subject to any disclaimer, the term of this patent is extended or adjusted under 35 U.S.C. 154(b) by 431 days.

(21) Appl. No.: 16/938,497

(22) Filed: Jul. 24, 2020

(65) Prior Publication Data

US 2020/0354642 A1 Nov. 12, 2020

Related U.S. Application Data

(63) Continuation of application No. 13/583,024, filed as application No. PCT/GB2011/050479 on Mar. 10, 2011, now abandoned.

(30) Foreign Application Priority Data

Mar. 10, 2010 (GB) ..... 1003973

(51) Int. Cl.

| | |
|---|---|
| ***C10L 1/18*** | (2006.01) |
| ***C10L 1/22*** | (2006.01) |
| ***C10L 10/04*** | (2006.01) |
| ***C10L 10/06*** | (2006.01) |
| *C10L 1/182* | (2006.01) |
| *C10L 1/188* | (2006.01) |
| *C10L 1/189* | (2006.01) |
| *C10L 1/226* | (2006.01) |
| *C10L 1/232* | (2006.01) |
| *C10L 1/2383* | (2006.01) |
| *C10L 1/2387* | (2006.01) |

(52) U.S. Cl.

CPC ..... *C10L 10/04* (2013.01); *C10L 1/18* (2013.01); *C10L 1/22* (2013.01); *C10L 10/06* (2013.01); *C10L 1/1817* (2013.01); *C10L 1/1824* (2013.01); *C10L 1/1881* (2013.01); *C10L 1/189* (2013.01); *C10L 1/221* (2013.01); *C10L 1/226* (2013.01); *C10L 1/232* (2013.01); *C10L 1/2383* (2013.01); *C10L 1/2387* (2013.01); *C10L 2200/0259* (2013.01); *C10L 2200/029* (2013.01); *C10L 2200/0446* (2013.01); *C10L 2250/04* (2013.01); *C10L 2270/026* (2013.01)

(58) Field of Classification Search

CPC .. C10L 1/18; C10L 1/22; C10L 1/1817; C10L 2200/0446

See application file for complete search history.

(56) References Cited

U.S. PATENT DOCUMENTS

| | | | |
|---|---|---|---|
| 2,812,342 | A | 11/1957 | Peters |
| 3,018,250 | A | 1/1962 | Anderson et al. |
| 3,110,673 | A | 11/1963 | Benoit, Jr. |
| 3,172,892 | A | 3/1965 | Le Suer et al. |
| 3,216,936 | A | 11/1965 | Le Suer |
| 3,219,666 | A | 11/1965 | Norman et al. |
| 3,231,587 | A | 1/1966 | Rense et al. |
| 3,250,715 | A | 5/1966 | Wyman et al. |
| 3,251,853 | A | 5/1966 | Hoke |
| 3,260,671 | A | 7/1966 | Trites et al. |
| 3,272,746 | A | 9/1966 | Le Suer et al. |
| 3,310,492 | A | 3/1967 | Benoit, Jr. |
| 3,326,801 | A | 6/1967 | Schlobohm et al. |
| 3,337,459 | A | 8/1967 | Ford |
| 3,341,542 | A | 9/1967 | Suer et al. |
| 3,361,673 | A | 1/1968 | Stuart et al. |
| 3,405,064 | A | 10/1968 | Miller |
| 3,429,674 | A | 2/1969 | Hoke |
| 3,444,170 | A | 5/1969 | Norman et al. |
| 3,455,831 | A | 7/1969 | Davis |
| 3,455,832 | A | 7/1969 | Davis |

(Continued)

FOREIGN PATENT DOCUMENTS

| | | |
|---|---|---|
| EP | 0253150 A2 | 1/1988 |
| EP | 0565285 B1 | 5/1997 |

(Continued)

OTHER PUBLICATIONS

Submission filed by Total Marketing Services dated Sep. 28, 2020.

(Continued)

*Primary Examiner* — Ellen M McAvoy

*Assistant Examiner* — Ming Cheung Po

(74) *Attorney, Agent, or Firm* — ArentFox Schiff LLP; Yun H. Choe

(57) ABSTRACT

A method of reducing deposits in a diesel engine, the method comprising combusting in the engine a diesel fuel composition comprising a detergent additive which is not a quaternary ammonium salt or a Mannich reaction product; and a quaternary ammonium salt additive comprising the reaction product of nitrogen containing species having at least one tertiary amine group and a quaternizing agent; wherein the nitrogen containing species is selected from:

(i) the reaction product of a hydrocarbyl-substituted acylating agent and a compound comprising at least one tertiary amine group and a primary amine, secondary amine or alcohol group;

(ii) a Mannich reaction product comprising a tertiary amine group; and (v) a polyalkylene substituted amine having at least one tertiary amine group.

10 Claims, No Drawings

(56) References Cited

U.S. PATENT DOCUMENTS

| | | | | |
|---|---|---|---|---|
| 3,468,639 | A | 9/1969 | Lindstrom et al. | |
| 3,576,743 | A | 4/1971 | Widmer et al. | |
| 3,630,904 | A | 12/1971 | Musser et al. | |
| 3,632,511 | A | 1/1972 | Liao | |
| 3,778,371 | A | 12/1973 | Malec | |
| 3,804,763 | A | 4/1974 | Meinhardt | |
| 3,857,791 | A | 12/1974 | Marcellis et al. | |
| 4,171,959 | A | 10/1979 | Vartanian | |
| 4,234,435 | A | 11/1980 | Meinhardt et al. | |
| 4,248,719 | A * | 2/1981 | Chafetz | C10M 133/56 508/293 |
| 4,253,980 | A | 3/1981 | Hammond et al. | |
| 4,326,973 | A | 4/1982 | Hammond et al. | |
| 4,338,206 | A | 7/1982 | Hammond et al. | |
| 5,254,138 | A | 10/1993 | Kurek | |
| 6,299,655 | B1 * | 10/2001 | Steckel | C08G 73/0206 44/418 |
| 6,733,550 | B1 | 5/2004 | Grundy et al. | |
| 6,784,317 | B2 | 8/2004 | Kanbara et al. | |
| 6,821,307 | B2 | 11/2004 | Caprotti et al. | |
| 7,906,470 | B2 | 3/2011 | Stevenson et al. | |
| 7,947,093 | B2 | 5/2011 | Barton et al. | |
| 7,951,211 | B2 | 5/2011 | Barton et al. | |
| 8,083,814 | B2 | 12/2011 | Stevenson et al. | |
| 8,147,569 | B2 | 4/2012 | Barton et al. | |
| 8,460,404 | B2 | 6/2013 | Hollingshurst | |
| 8,715,375 | B2 | 5/2014 | Reid | |
| 9,034,060 | B2 | 5/2015 | MacMillan | |
| 9,062,265 | B2 | 6/2015 | Reid et al. | |
| 9,085,740 | B2 | 7/2015 | Reid | |
| 9,163,190 | B2 | 10/2015 | Reid | |
| 2005/0181959 | A1 | 8/2005 | Esche, Jr. | |
| 2008/0052985 | A1 * | 3/2008 | Stevenson | C10M 159/16 106/31.43 |
| 2008/0113890 | A1 | 5/2008 | Moreton et al. | |
| 2008/0141580 | A1 | 6/2008 | Tack | |
| 2008/0281500 | A1 | 11/2008 | Nakata et al. | |
| 2008/0307698 | A1 * | 12/2008 | Barton | C10L 1/2387 44/435 |
| 2009/0063016 | A1 | 3/2009 | Nakata et al. | |
| 2009/0282731 | A1 * | 11/2009 | Malfer | C10L 1/2383 44/387 |
| 2010/0077994 | A1 | 4/2010 | Manubolu et al. | |
| 2010/0108025 | A1 | 5/2010 | Yuzaki et al. | |
| 2010/0126468 | A1 | 5/2010 | Martin | |
| 2010/0257779 | A1 * | 10/2010 | Barton | C10L 1/2387 44/422 |
| 2011/0130317 | A1 | 6/2011 | Stevenson et al. | |
| 2011/0143981 | A1 | 6/2011 | Barton et al. | |
| 2011/0185626 | A1 | 8/2011 | Barton et al. | |
| 2012/0138004 | A1 | 6/2012 | Stevenson et al. | |
| 2012/0192483 | A1 | 8/2012 | Barton et al. | |
| 2013/0118062 | A1 | 5/2013 | Fang et al. | |

FOREIGN PATENT DOCUMENTS

| | | | | |
|---|---|---|---|---|
| EP | 0293192 | A1 | 11/1998 | |
| EP | 1254889 | A1 | 11/2002 | |
| EP | 1344785 | A1 | 9/2003 | |
| EP | 1884556 | A2 * | 2/2008 | C10L 1/1826 |
| EP | 1887074 | A1 | 2/2008 | |
| EP | 1900795 | A1 | 3/2008 | |
| EP | 1884556 | A3 * | 9/2011 | C10L 1/1852 |
| GB | 1001920.6 | A | 2/2011 | |
| WO | 199812282 | A1 | 3/1998 | |
| WO | 2002006428 | A1 | 1/2002 | |
| WO | WO-2006135881 | A2 * | 12/2006 | C10M 163/00 |
| WO | 2007015080 | A1 | 2/2007 | |
| WO | 2009040583 | A1 | 4/2009 | |
| WO | 2009055518 | A1 | 4/2009 | |
| WO | WO-2009040586 | A1 * | 4/2009 | C10L 1/221 |
| WO | 20090140190 | A1 | 11/2009 | |
| WO | 2010097624 | A1 | 9/2010 | |
| WO | 2010132259 | A1 | 11/2010 | |
| WO | 2011110860 | A1 | 9/2011 | |
| WO | 2015/011505 | A1 | 1/2015 | |

OTHER PUBLICATIONS

Submission filed by Afton dated Oct. 12, 2020.
"Observations in Preparation for the Oral Proceedings," dated Sep. 13, 2019, filed by Total Marketing Services in connection with EP 2545145.
"Observations in Preparation for the Oral Proceedings," dated Oct. 15, 2019, filed by Total Marketing Services in connection with EP 2545145.
Huntsman Product Data Sheet for Ethyleneamine E-100.
Herbstman et al., "Clean Diseal Exhaust", vol. 20(4); 242-7; Chemtech, Apr. 1990.
Stepina et al., "Lubricants and Special Fluids", Elsevier, Tribology Series 23 1992, at p. 316.
Beck et al., "Development of Multifunctional Detergent-Dispersant Additives Based on Fatty Acid Methyl Ester for Diesel and Biodiesel Fuel", InTech, ISBN: 978-953-307-784-0, Nov. 16, 2011.
Correspondence to EPO from Opponent dated Jan. 10, 2019, regarding Opposition to EP Patent 2545145.
English translation of Notice of Opposition and Written Submissions Filed by Total Marketing Services in corresponding European Appl. No. 11709796.4, dated Apr. 26, 2018, 19 pgs.
Submission filed in EP Application No. 09742724.0 dated Feb. 8, 2011.
EPO Communication issued in EP Application No. 09742724.0 dated Aug. 19, 2011.
Kirk, et al., eds. Encyclopedia of Chemical Technology. New York: Interscience Publications. 5(1950):898-905.
Zoller, et. Handbook of Detergents Part E: Applications. Boca Raton, FL: CRC Press. 141(2009): 331, 341-342.
Submission filed in EP Application No. 15178160.6 dated Jul. 13, 2016.
Reid et al., "Understanding Polyisobutylene Succinimides (PIBSI) and Internal Diesel Injector Deposits. "SAE International. Published Oct. 14, 2013.
"Fuel Additives and the Environment," Additive Technical Committee (ATC), Published Jan. 1, 2004.
Ullmann et al., "Effects of Fuel Impurities and Additive Interactions on the Formation of Internal Diesel Injector Deposits," 7th International Colloquim Fuels, (2009):377-388.
The American Chemistry Council, High Production Volume (HPV) Challenge Program: Final Submission for Succinimide Dispersants, (2006).
Declaration of Scott D. Schwab filed in EP Patent 2545145 B1 dated Mar. 14, 2018.
Statement of Facts and Arguments in Support of Opposition filed in EP Patent 2545145 B1 dated Mar. 14, 2018.
International Search Report for International Application No. PCT/GB2011/050479 dated Jun. 15, 2011.
International Preliminary Report on Patentability for International Application No. PCT/GB2011/050479 dated Sep. 11, 2012.
Response to Summons to Oral Proceedings, dated Sep. 12, 2019, filed by Afron Chemical Co., in connection with EP 2545145.
Further experimental data filed Feb. 18, 2014.
Notice of Opposition and Written Submissions filed by Total Marketing Services in European application No. 11709796.4 dated Apr. 26, 2018.
Submission in EP Application No. 18189048.4 (EP Patent No. 3447111) dated Sep. 15, 2023, 76 pages.
Reid et al., "Internal Injector Deposits from Sodium Sources," Apr. 1, 2014, SAE Int. J. Fuels Lubr., vol. 7, Iss. 2, pp. 1-9, 2014.
Patentee's Response to the Notice of Opposition against EP3024914B1, submitted to European Patent Office on May 23, 2019 on behalf of the Patentee.
Decision rejecting the opposition (Art. 101(2) EPC) issued in EP Application No. 14744945.8, mailed on Apr. 3, 2020.

* cited by examiner

FUEL COMPOSITION COMPRISING DETERGENT AND QUATERNARY AMMONIUM SALT ADDITIVE

CROSS-REFERENCE TO RELATED APPLICATIONS

This present application is a continuation of co-pending U.S. application Ser. No. 13/583,024, filed Oct. 1, 2012, which is a U.S. national stage application under 35 U.S.C. § 371 of International Application No. PCT/GB11/050479 filed on Mar. 10, 2011 and entitled "FUEL COMPOSITION COMPRISING DETERGENT AND QUATERNARY AMMONIUM SALT ADDITIVE," which in turn claims priority to Great Britain Patent Application No. 1003973.3 filed on Mar. 10, 2010, the disclosures of which are incorporated by reference herein their entireties for all purposes.

The present invention relates to fuel compositions and additives thereto. In particular the invention relates to additives for diesel fuel compositions, especially those suitable for use in modern diesel engines with high pressure fuel systems.

Due to consumer demand and legislation, diesel engines have in recent years become much more energy efficient, show improved performance and have reduced emissions.

These improvements in performance and emissions have been brought about by improvements in the combustion process. To achieve the fuel atomisation necessary for this improved combustion, fuel injection equipment has been developed which uses higher injection pressures and reduced fuel injector nozzle hole diameters. The fuel pressure at the injection nozzle is now commonly in excess of 1500 bar ($1.5\times10^8$ Pa). To achieve these pressures the work that must be done on the fuel also increases the temperature of the fuel. These high pressures and temperatures can cause degradation of the fuel.

Diesel engines having high pressure fuel systems can include but are not limited to heavy duty diesel engines and smaller passenger car type diesel engines. Heavy duty diesel engines can include very powerful engines such as the MTU series 4000 diesel having 20 cylinder variants designed primarily for ships and power-generation with power output up to 4300 kW or engines such as the Renault dXi 7 having 6 cylinders and a power output around 240 kW. A typical passenger car diesel engine is the Peugeot DW10 having 4 cylinders and power output of 100 kW or less depending on the variant.

In all of the diesel engines relating to this invention, a common feature is a high pressure fuel system. Typically pressures in excess of 1350 bar ($1.35\times10^8$ Pa) are used but often pressures of up to 2000 bar ($2\times10^8$ Pa) or more may exist.

Two non-limiting examples of such high pressure fuel systems are: the common rail injection system, in which the fuel is compressed utilizing a high-pressure pump that supplies it to the fuel injection valves through a common rail; and the unit injection system which integrates the high-pressure pump and fuel injection valve in one assembly, achieving the highest possible injection pressures exceeding 2000 bar ($2\times10^8$ Pa). In both systems, in pressurising the fuel, the fuel gets hot, often to temperatures around 100° C., or above.

In common rail systems, the fuel is stored at high pressure in the central accumulator rail or separate accumulators prior to being delivered to the injectors. Often, some of the heated fuel is returned to the low pressure side of the fuel system or returned to the fuel tank. In unit injection systems the fuel is compressed within the injector in order to generate the high injection pressures. This in turn increases the temperature of the fuel.

In both systems, fuel is present in the injector body prior to injection where it is heated further due to heat from the combustion chamber. The temperature of the fuel at the tip of the injector can be as high as 250-350° C.

Thus the fuel is stressed at pressures from 1350 bar ($1.35\times10^8$ Pa) to over 2000 bar ($2\times10^8$ Pa) and temperatures from around 100° C. to 350° C. prior to injection, sometimes being recirculated back within the fuel system thus increasing the time for which the fuel experiences these conditions.

A common problem with diesel engines is fouling of the injector, particularly the injector body, and the injector nozzle. Fouling may also occur in the fuel filter. Injector nozzle fouling occurs when the nozzle becomes blocked with deposits from the diesel fuel. Fouling of fuel filters may be related to the recirculation of fuel back to the fuel tank. Deposits increase with degradation of the fuel. Deposits may take the form of carbonaceous coke-like residues or sticky or gum-like residues. Diesel fuels become more and more unstable the more they are heated, particularly if heated under pressure. Thus diesel engines having high pressure fuel systems may cause increased fuel degradation.

The problem of injector fouling may occur when using any type of diesel fuels. However, some fuels may be particularly prone to cause fouling or fouling may occur more quickly when these fuels are used. For example, fuels containing biodiesel have been found to produce injector fouling more readily. Diesel fuels containing metallic species may also lead to increased deposits. Metallic species may be deliberately added to a fuel in additive compositions or may be present as contaminant species. Contamination occurs if metallic species from fuel distribution systems, vehicle distribution systems, vehicle fuel systems, other metallic components and lubricating oils become dissolved or dispersed in fuel.

Transition metals in particular cause increased deposits, especially copper and zinc species. These may be typically present at levels from a few ppb (parts per billion) up to 50 ppm, but it is believed that levels likely to cause problems are from 0.1 to 50 ppm, for example 0.1 to 10 ppm.

When injectors become blocked or partially blocked, the delivery of fuel is less efficient and there is poor mixing of the fuel with the air. Over time this leads to a loss in power of the engine, increased exhaust emissions and poor fuel economy.

As the size of the injector nozzle hole is reduced, the relative impact of deposit build up becomes more significant. By simple arithmetic a 5 μm layer of deposit within a 500 μm hole reduces the flow area by 4% whereas the same 5 μm layer of deposit in a 200 μm hole reduces the flow area by 9.8%.

At present, nitrogen-containing detergents may be added to diesel fuel to reduce coking. Typical nitrogen-containing detergents are those formed by the reaction of a polyisobutylene-substituted succinic acid derivative with a polyalkylene polyamine. However, newer engines including finer injector nozzles are more sensitive and current diesel fuels may not be suitable for use with the new engines incorporating these smaller nozzle holes.

The present inventor has developed diesel fuel compositions which when used in diesel engines having high pressure fuel systems provide improved performance compared with diesel fuel compositions of the prior art.

It is advantageous to provide a diesel fuel composition which prevents or reduces the occurrence of deposits in a diesel engine. Such fuel compositions may be considered to perform a "keep clean" function i.e. they prevent or inhibit fouling.

However it would also be desirable to provide a diesel fuel composition which would help clean up deposits that have already formed in an engine, in particular deposits which have formed on the injectors. Such a fuel composition which when combusted in a diesel engine removes deposits therefrom thus effecting the "clean-up" of an already fouled engine.

As with "keep clean" properties, "clean-up" of a fouled engine may provide significant advantages. For example, superior clean up may lead to an increase in power and/or an increase in fuel economy. In addition removal of deposits from an engine, in particular from injectors may lead to an increase in interval time before injector maintenance or replacement is necessary thus reducing maintenance costs.

Although for the reasons mentioned above deposits on injectors is a particular problem found in modern diesel engines with high pressure fuels systems, it is desirable to provide a diesel fuel composition which also provides effective detergency in older traditional diesel engines such that a single fuel supplied at the pumps can be used in engines of all types.

It is also desirable that fuel compositions reduce the fouling of vehicle fuel filters. It would be useful to provide compositions that prevent or inhibit the occurrence of fuel filter deposits i.e, provide a "keep clean" function. It would be useful to provide compositions that remove existing deposits from fuel filter deposits i.e. provide a "clean up" function. Compositions able to provide both of these functions would be especially useful.

According to a first aspect of the present invention there is provided a method of reducing deposits in a diesel engine, the method comprising combusting in the engine a diesel fuel composition comprising a detergent additive which is not a quaternary ammonium salt or a Mannich reaction product; and a quaternary ammonium salt additive comprising the reaction product of nitrogen containing species having at least one tertiary amine group and a quaternizing agent; wherein the nitrogen containing species is selected from:

(i) the reaction product of a hydrocarbyl-substituted acylating agent and a compound comprising at least one tertiary amine group and a primary amine, secondary amine or alcohol group;

(ii) a Mannich reaction product comprising a tertiary amine group; and (iii) a polyalkylene substituted amine having at least one tertiary amine group.

Examples of quaternary ammonium salt and methods for preparing the same are described in the following patents, which are hereby incorporated by reference, U.S. Pat. Nos. 4,253,980, 3,778,371, 4,171,959, 4,326,973, 4,338,206, and 5,254,138.

Component (i) may be regarded as the reaction product of a hydrocarbyl-substituted acylating agent and a compound having an oxygen or nitrogen atom capable of condensing with said acylating agent and further having a tertiary amino group.

When the nitrogen containing species includes component (i), the hydrocarbyl substituted acylating agent is preferably a mono- or polycarboxylic acid (or reactive equivalent thereof) for example a substituted succinic, phthalic or propionic acid.

The hydrocarbyl substituent in such acylating agents preferably comprises at least 8, more preferably at least 12, for example 30 or 50 carbon atoms. It may comprise up to about 200 carbon atoms. Preferably the hydrocarbyl substituent of the acylating agent has a number average molecular weight (Mn) of between 170 to 2800, for example from 250 to 1500, preferably from 500 to 1500 and more preferably 500 to 1100. An Mn of 700 to 1300 is especially preferred, for example from 700 to 1000.

Illustrative of hydrocarbyl substituent based groups containing at least eight carbon atoms are n-octyl, n-decyl, n-dodecyl, tetrapropenyl, n-octadecyl, oleyl, chloroctadecyl, triicontanyl, etc. The hydrocarbyl based substituents may be made from homo- or interpolymers (e.g. copolymers, terpolymers) of mono- and di-olefins having 2 to 10 carbon atoms, for example ethylene, propylene, butane-1, isobutene, butadiene, isoprene, 1-hexene, 1-octene, etc. Preferably these olefins are 1-monoolefins. The hydrocarbyl substituent may also be derived from the halogenated (e.g. chlorinated or brominated) analogs of such homo- or interpolymers. Alternatively the substituent may be made from other sources, for example monomeric high molecular weight alkenes (e.g. 1-tetra-contene) and chlorinated analogs and hydrochlorinated analogs thereof, aliphatic petroleum fractions, for example paraffin waxes and cracked and chlorinated analogs and hydrochlorinated analogs thereof, white oils, synthetic alkenes for example produced by the Ziegler-Natta process (e.g. poly(ethylene) greases) and other sources known to those skilled in the art. Any unsaturation in the substituent may if desired be reduced or eliminated by hydrogenation according to procedures known in the art.

The term "hydrocarbyl" as used herein denotes a group having a carbon atom directly attached to the remainder of the molecule and having a predominantly aliphatic hydrocarbon character. Suitable hydrocarbyl based groups may contain non-hydrocarbon moieties. For example they may contain up to one non-hydrocarbyl group for every ten carbon atoms provided this non-hydrocarbyl group does not significantly alter the predominantly hydrocarbon character of the group. Those skilled in the art will be aware of such groups, which include for example hydroxyl, halo (especially chloro and fluoro), alkoxyl, alkyl mercapto, alkyl sulphoxy, etc. Preferred hydrocarbyl based substituents are purely aliphatic hydrocarbon in character and do not contain such groups.

The hydrocarbyl-based substituents are preferably predominantly saturated, that is, they contain no more than one carbon-to-carbon unsaturated bond for every ten carbon-to-carbon single bonds present. Most preferably they contain no more than one carbon-to-carbon non-aromatic unsaturated bond for every 50 carbon-to-carbon bonds present.

In some preferred embodiments, the hydrocarbyl-based substituents are poly-(isobutene)s known in the art. Thus in especially preferred embodiments the hydrocarbyl substituted acylating agent is a polyisobutenyl substituted succinic anhydride.

The preparation of polyisobutenyl substituted succinic anhydrides (PIBSA) is documented in the art. Suitable processes include thermally reacting polyisobutenes with maleic anhydride (see for example U.S. Pat. Nos. 3,361,673 and 3,018,250), and reacting a halogenated, in particular a chlorinated, polyisobutene (PIB) with maleic anhydride (see for example U.S. Pat. No. 3,172,892). Alternatively, the polyisobutenyl succinic anhydride can be prepared by mixing the polyolefin with maleic anhydride and passing chlorine through the mixture (see for example GB-A-949,981).

Conventional polyisobutenes and so-called "highly-reactive" polyisobutenes are suitable for use in the invention. Highly reactive polyisobutenes in this context are defined as polyisobutenes wherein at least 50%, preferably 70% or more, of the terminal olefinic double bonds are of the vinylidene type as described in EP0565285. Particularly preferred polyisobutenes are those having more than 80 mol % and up to 100% of terminal vinylidene groups such as those described in EP1344785.

Other preferred hydrocarbyl groups include those having an internal olefin for example as described in the applicant's published application WO2007/015080.

An internal olefin as used herein means any olefin containing predominantly a non-alpha double bond, that is a beta or higher olefin. Preferably such materials are substantially completely beta or higher olefins, for example containing less than 10% by weight alpha olefin, more preferably less than 5% by weight or less than 2% by weight. Typical internal olefins include Neodene 1518IO available from Shell.

Internal olefins are sometimes known as isomerised olefins and can be prepared from alpha olefins by a process of isomerisation known in the art, or are available from other sources. The fact that they are also known as internal olefins reflects that they do not necessarily have to be prepared by isomerisation.

Examples of the nitrogen or oxygen containing compounds capable of condensing with the acylating agent and further having a tertiary amino group can include but are not limited to: N,N-dimethylaminopropylamine, N,N-diethylaminopropylamine, N,N-dimethylamino ethylamine. The nitrogen or oxygen containing compounds capable of condensing with the acylating agent and further having a tertiary amino group can further include amino alkyl substituted heterocyclic compounds such as 1-(3-aminopropyl)imidazole and 4-(3-aminopropyl)morpholine, 1-(2-aminoethyl) piperidine, 3,3-diamino-N-methyldipropylamine, and 3'3-aminobis(N,N-dimethylpropylamine). Other types of nitrogen or oxygen containing compounds capable of condensing with the acylating agent and having a tertiary amino group include alkanolamines including but not limited to triethanolamine, trimethanolamine, N,N-dimethylaminopropanol, N,N-dimethylaminoethanol, N,N-diethylaminopropanol, N,N-diethylaminoethanol, N,N-diethylaminobutanol, N,N,N-tris(hydroxyethyl)amine, N,N,N-tris(hydroxymethyl)amine, N,N,N-tris(aminoethyl)amine, N,N-dibutylaminopropylamine and N,N,N'-trimethyl-N'-hydroxyethylbisaminoethylether; N,N-bis(3-dimethylaminopropyl)-N-isopropanolamine; N-(3-dimethylaminopropyl)-N,N-diisopropanolamine; N'-(3-(dimethylamino)propyl)-N,N-dimethyl 1,3-propanediamine; 2-(2-dimethylaminoethoxy) ethanol, and N,N,N'-trimethylaminoethylethanolamine.

In some preferred embodiments component (i) comprises a compound formed by the reaction of a hydrocarbyl-substituted acylating agent and an amine of formula (I) or (II):

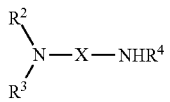

(I)

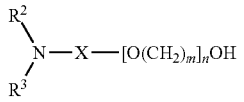

(II)

wherein $R^2$ and $R^3$ are the same or different alkyl groups having from 1 to 22 carbon atoms; X is an alkylene group having from 1 to 20 carbon atoms; n is from 0 to 20; m is from 1 to 5; and $R^4$ is hydrogen or a $C_1$ to $C_{22}$ alkyl group.

When a compound of formula (I) is used, $R^4$ is preferably hydrogen or a $C_1$ to $C_{10}$ alkyl group, preferably a $C_1$ to $C_{10}$ alkyl group, more preferably a $C_1$ to $C_6$ alkyl group. More preferably $R^4$ is selected from hydrogen, methyl, ethyl, propyl, butyl and isomers thereof. Most preferably $R^4$ is hydrogen.

When a compound of formula (II) is used, m is preferably 2 or 3, most preferably 2; n is preferably from 0 to 15, preferably 0 to 10, more preferably from 0 to 5. Most preferably n is 0 and the compound of formula (II) is an alcohol.

Preferably the hydrocarbyl substituted acylating agent is reacted with a diamine compound of formula (I).

$R^2$ and $R^3$ may each independently be a $C_1$ to $C_{16}$ alkyl group, preferably a $C_1$ to $C_{10}$ alkyl group. $R^2$ and $R^3$ may independently be methyl, ethyl, propyl, butyl, pentyl, hexyl, heptyl, octyl, or an isomer of any of these. Preferably $R^2$ and $R^3$ is each independently $C_1$ to $C_4$ alkyl. Preferably $R^2$ is methyl. Preferably $R^3$ is methyl.

X is preferably an alkylene group having 1 to 16 carbon atoms, preferably 1 to 12 carbon atoms, more preferably 1 to 8 carbon atoms, for example 2 to 6 carbon atoms or 2 to 5 carbon atoms. Most preferably X is an ethylene, propylene or butylene group, especially a propylene group.

The preparation of suitable quaternary ammonium salt additives in which the nitrogen-containing species includes component (i) is described in WO 2006/135881.

In preferred embodiments component (i) is the reaction product of a hydrocarbyl-substituted succinic acid derivative (suitably a polyisobutylene-substituted succinic anhydride) and an alcohol or amine also including a tertiary amine group.

In some embodiments when the succinic acid derivative is reacted with an amine (also including a tertiary amine group) under conditions to form a succinimide.

In an alternative embodiment the reaction of the succinic acid derivative and the amine may be carried out under conditions which result in the formulation of a succinamide i.e., a compound including an amide group and a carboxylic acid group.

In embodiments in which an alcohol (also including a tertiary amine group) is reacted with the succinic acid derivative an ester results. This ester molecule also includes a free carboxylic acid group.

Thus in some embodiments component (i) may be the reaction product of a succinic acid derivative and an amine or alcohol which is an ester or an amide and which also includes a further unreacted carboxylic acid group.

Component (ii) is a Mannich reaction product having a tertiary amine. The preparation of quaternary ammonium salts formed from nitrogen-containing species including component (ii) is described in US 2008/0052985.

The Mannich reaction product having a tertiary amine group is prepared from the reaction of a hydrocarbyl-substituted phenol, an aldehyde and an amine.

The hydrocarbyl substituent of the hydrocarbyl substituted phenol can have 6 to 400 carbon atoms, suitably 30 to 180 carbon atoms, for example 10 or 40 to 110 carbon atoms. This hydrocarbyl substituent can be derived from an olefin or a polyolefin. Useful olefins include alpha-olefins, such as 1-decene, which are commercially available.

The polyolefins which can form the hydrocarbyl substituent can be prepared by polymerizing olefin monomers by well known polymerization methods and are also commercially available.

Some preferred polyolefins include polyisobutylenes having a number average molecular weight of 400 to 3000, in another instance of 400 to 2500, and in a further instance of 400 or 500 to 1500.

The hydrocarbyl-substituted phenol can be prepared by alkylating phenol with an olefin or polyolefin described above, such as, a polyisobutylene or polypropylene, using well-known alkylation methods.

In some embodiments the phenol may include a lower molecular weight alkyl substituent for example a phenol which carries one or more alkyl chains having a total of less 28 carbon atoms, preferably less than 24 carbon atoms, more preferably less than 20 carbon atoms, preferably less than 18 carbon atoms, preferably less than 16 carbon atoms and most preferably less than 14 carbon atoms.

A monoalkyl phenol may be preferred, suitably having from 4 to 20 carbons atoms, preferably 6 to 18, more preferably 8 to 16, especially 10 to 14 carbon atoms, for example a phenol having a C12 alkyl substituent.

The aldehyde used to form the Mannich detergent can have 1 to 10 carbon atoms, and is generally formaldehyde or a reactive equivalent thereof such as formalin or paraformaldehyde.

The amine used to form the Mannich detergent can be a monoamine or a polyamine.

Examples of monoamines include but are not limited to ethylamine, dimethylamine, diethylamine, n-butylamine, dibutylamine, allylamine, isobutylamine, cocoamine, stearylamine, laurylamine, methyllaurylamine, oleylamine, N-methyl-octylamine, dodecylamine, diethanolamine, morpholine, and octadecylamine.

Suitable polyamines may be selected from any compound including two or more amine groups. Suitable polyamines include polyalkylene polyamines, for example in which the alkylene component has 1 to 6, preferably 1 to 4, most preferably 2 to 3 carbon atoms. Preferred polyamines are polyethylene polyamines.

The polyamine has 2 to 15 nitrogen atoms, preferably 2 to 10 nitrogen atoms, more preferably 2 to 8 nitrogen atoms.

In especially preferred embodiments the amine used to form the Mannich detergent comprises a diamine. Suitably it includes a primary or secondary amine which takes part in the Mannich reaction and in addition a tertiary amine.

In preferred embodiments component (ii) comprises the product directly obtained from a Mannich reaction and comprising a tertiary amine. For example the amine may comprise a single primary or secondary amine which when reacted in the Mannich reaction forms a tertiary amine which is capable of being quaternised. Alternatively the amine may comprise a primary or secondary amine capable of taking part in the Mannich reaction and also a tertiary amine capable of being quaternised. However component (ii) may comprise a compound which has been obtained from a Mannich reaction and subsequently reacted to form a tertiary amine, for example a Mannich reaction may yield a secondary amine which is then alkylated to a tertiary amine.

The preparation of quaternary ammonium salt additives in which the nitrogen-containing species includes component (iii) is described for example in US 2008/0113890.

The polyalkene-substituted amines having at least one tertiary amino group of the present invention may be derived from an olefin polymer and an amine, for example ammonia, momoamines, polyamines or mixtures thereof. They may be prepared by a variety of methods such as those described and referred to in US 2008/0113890.

Suitable preparation methods include, but are not limited to: reacting a halogenated olefin polymer with an amine; reacting a hydroformylated olefin with a polyamine and hydrogenating the reaction product; converting a polyalkene into the corresponding epoxide and converting the epoxide into the polyalkene substituted amine by reductive animation; hydrogenation of a β-aminonitrile; and hydroformylating an polybutene or polyisobutylene in the presence of a catalyst, CO and $H_2$ at elevated pressure and temperatures.

The olefin monomers from which the olefin polymers are derived include polymerizable olefin monomers characterised by the presence of one or more ethylenically unsaturated groups for example ethylene, propylene, 1-butene, isobutene, 1-octene, 1,3-butadiene and isoprene.

The olefin monomers are usually polymerizable terminal olefins. However, polymerizable internal olefin monomers can also be used to form the polyalkenes.

Examples of terminal and internal olefin monomers, which can be used to prepare the polyalkenes according to conventional, well-known polymerization techniques include: ethylene; propylene; butenes, including 1-butene, 2-butene and isobutylene; 1-pentene; 1-hexene; 1-heptene; 1-octene; 1-nonene; 1-decene; 2-pentene; propylene-tetramer; diisobutylene; isobutylene trimer; 1,2-butadiene; 1,3-butadiene; 1,2-pentadiene; 1,3-pentadiene; 1,4-pentadiene; isoprene; 1,5-hexadiene; 2-methyl-5-propyl-1-hexene; 3-pentene; 4-octene; and 3,3-dimethyl-1-pentene.

Suitably the polyalkene substituent of the polyalkene-substituted amine is derived from a polyisobutylene.

The amines that can be used to make the polyalkene-substituted amine include ammonia, monoamines, polyamines, or mixtures thereof, including mixtures of different monoamines, mixtures of different polyamines, and mixtures of monoamines and polyamines (which include diamines). The amines include aliphatic, aromatic, heterocyclic and carbocylic amines.

The monomers and polyamines suitably include at least one primary or secondary amine group.

Suitable monoamines are generally substituted with a hydrocarbyl group having 1 to about 50 carbon atoms, preferably 1 to 30 carbon atoms. Saturated aliphatic hydrocarbon radicals are particularly preferred.

Examples of suitable monoamines include methylamine, ethylamine, diethylamine, 2-ethylhexylamine, di-(2-ethylhexyl)amine, n-butylamine, di-n-butylamine, allylamine, isobutylamine, cocoamine, stearylamine, laurylamine, methyllaurylamine and oleylamine.

Aromatic monoamines include those monoamines wherein a carbon atom of the aromatic ring structure is attached directly to the amine nitrogen. Examples of aromatic monoamines include aniline, di(para-methylphenyl) amine, naphthylamine, and N-(n-butyl)aniline.

Examples of aliphatic substituted, cycloaliphatic-substituted, and heterocyclic-substituted aromatic monoamines include: para-dodecylaniline, cyclohexyl-substituted naphthylamine, and thienyl-substituted aniline respectively.

Hydroxy amines are also included in the class of useful monoamines. Examples of hydroxyl-substituted monoamines include ethanolamine, di-3-propanolamine, 4-hydroxybutylamine; diethanolamine, and N-methyl-2-hydroxypropylamine.

The amine of the polyalkene-substituted amine can be a polyamine. The polyamine may be aliphatic, cycloaliphatic, heterocyclic or aromatic.

Examples of suitable polyamines include alkylene polyamines, hydroxy containing polyamines, arylpolyamines, and heterocyclic polyamines.

Ethylene polyamines, are especially useful for reasons of cost and effectiveness. Suitable ethylene polyamines are described in relation to the first aspect.

Suitable hydroxy containing polyamines include hydroxyalkyl alkylene polyamines having one or more hydroxyalkyl substituents on the nitrogen atoms and can be prepared by reacting alkylenepolyamines with one or more alkylene oxides. Examples of suitable hydroxyalkyl-substituted polyamines include: N-(2-hydroxyethyl)ethylene diamine, N,N-bis(2-hydroxyethyl)ethylene diamine, 1-(2-hydroxyethyl) piperazine, monohydroxypropl-substituted diethylene triamine, dihydroxypropyl-substituted tetraethylene pentamine, propyl and N-(3-hydroxybutyl)tetramethylene diamine.

Suitable arylpolyamines are analogous to the aromatic monoamines mentioned above except for the presence within their structure of another amino nitrogen. Some examples of arylpolyamines include N,N'-di-n-butyl-para-phenylene diamine and bis-(para-aminophenyl)methane.

Suitable heterocyclic mono- and polyamines will be known to the person skilled in the art. Specific examples of such heterocyclic amines include N-aminopropylmorpholine, N-aminoethylpiperazine, and N,N'-diaminoethylpiperazine. Hydroxy heterocyclic polyamines may also be used for example N-(2-hydroxyethyl)cyclohexylamine, 3-hydroxycyclopentylamine, parahydroxy-aniline and N-hydroxyethylpiperazine.

Examples of polyalkene-substituted amines can include: poly(propylene)amine, poly(butene)amine, N,N-dimethylpolyisobutyleneamine; N-polybutenemorpholine, N-poly(butene)ethylenediamine, N-poly(propylene) trimethylenediamine, N-poly(butene)diethylenetriamine, N',N'-poly(butene)tetraethylenepentamine, and N,N-dimethyl-N'poly(propylene)-1,3 propylenediamine.

The number average molecular weight of the polyalkene-substituted amines can range from 500 to 5000, or from 500 to 3000, for example from 1000 to 1500.

Any of the above polyalkene-substituted amines which are secondary or primary amines, may be alkylated to tertiary amines using alkylating agents. Suitable alkylating agents and method using these will be known to the person skilled in the art.

To form the quaternary ammonium salt additives useful in the present invention, the nitrogen containing species having a tertiary amine group is reacted with a quaternizing agent.

The quaternizing agent is suitably selected from the group consisting of dialkyl sulphates; an ester of a carboxylic acid; alkyl halides; benzyl halides; hydrocarbyl substituted carbonates; and hydrocarbyl epoxides in combination with an acid or mixtures thereof.

In fuel applications it is often desirable to reduce the levels of halogen-, sulfur-, and phosphorus-containing species. Thus if a quaternizing agent containing such an element is used it may be advantageous to carry out a subsequent reaction to exchange the counterion. For example a quarternary ammonium salt formed by reaction with an alkyl halide could be subsequently reacted with sodium hydroxide and the sodium halide salt removed by filtration.

The quaternizing agent can include halides, such as chloride, iodide or bromide; hydroxides; sulphonates; bisulphites, alkyl sulphates, such as dimethyl sulphate; sulphones; phosphates; C1-12 alkylphosphates; di C1-12 alkylphosphates; borates; C1-12 alkylborates; nitrites; nitrates; carbonates; bicarbonates; alkanoates; O,O-di C1-12 alkyldithiophosphates; or mixtures thereof.

In one embodiment the quaternizing agent may be derived from dialkyl sulphates such as dimethyl sulphate, N-oxides, sulphones such as propane and butane sulphone; alkyl, acyl or aralkyl halides such as methyl and ethyl chloride, bromide or iodide or benzyl chloride, and a hydrocarbyl (or alkyl) substituted carbonates. If the acyl halide is benzyl chloride, the aromatic ring is optionally further substituted with alkyl or alkenyl groups. The hydrocarbyl (or alkyl) groups of the hydrocarbyl substituted carbonates may contain 1 to 50, 1 to 20, 1 to 10 or 1 to 5 carbon atoms per group. In one embodiment the hydrocarbyl substituted carbonates contain two hydrocarbyl groups that may be the same or different. Examples of suitable hydrocarbyl substituted carbonates include dimethyl or diethyl carbonate.

In another embodiment the quaternizing agent can be a hydrocarbyl epoxide, as represented by the following formula:

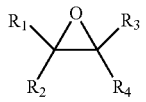

wherein R1, R2, R3 and R4 can be independently H or a C1-50 hydrocarbyl group.

Examples of hydrocarbyl epoxides can include styrene oxide, ethylene oxide, propylene oxide, butylene oxide, stilbene oxide and C2-50 epoxide. Styrene oxide is especially preferred.

Typically such hydrocarbyl epoxide quaternising agents are used in combination with an acid, for example acetic acid. However in embodiments in which component (i) includes the reaction product of a substituted succinic acid which is an ester or an amide and which also includes a further unreacted carboxylic acid group, an additional acid may be omitted and the hydrocarbyl epoxide may be used alone as the quaternising agent. It is believed that formation of the quaternary ammonium salt is promoted by protonation by the carboxylic acid group also present in the molecule.

In such embodiments in which a further acid is not used, the quaternary ammonium salt is suitably prepared in a protic solvent. Suitable protic solvents include water, alcohols (including polyhydric alcohols) and mixtures thereof. Preferred protic solvents have a dielectric constant of greater than 9.

Suitable quaternary ammonium salts prepared from amides and or esters of succinic acid derivatives are described in WO2010/132259.

In some preferred embodiments the quaternizing agent comprises a compound of formula (III):

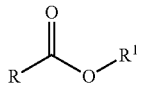

(III)

wherein R is an optionally substituted alkyl, alkenyl, aryl or alkylaryl group; and $R^1$ is a $C_1$ to $C_{22}$ alkyl, aryl or alkylaryl group.

The compound of formula (III) is an ester of a carboxylic acid capable of reacting with a tertiary amine to form a quaternary ammonium salt.

Suitable compounds of formula (III) include esters of carboxylic acids having a $pK_a$ of 3.5 or less.

The compound of formula (III) is preferably an ester of a carboxylic acid selected from a substituted aromatic carboxylic acid, an α-hydroxycarboxylic acid and a polycarboxylic acid.

In some preferred embodiments the compound of formula (III) is an ester of a substituted aromatic carboxylic acid and thus R is a substituted aryl group.

Preferably R is a substituted aryl group having 6 to 10 carbon atoms, preferably a phenyl or naphthyl group, most preferably a phenyl group. R is suitably substituted with one or more groups selected from carboalkoxy, nitro, cyano, hydroxy, $SR^5$ or $NR^5R^6$. Each of $R^5$ and $R^6$ may be hydrogen or optionally substituted alkyl, alkenyl, aryl or carboalkoxy groups. Preferably each of $R^5$ and $R^6$ is hydrogen or an optionally substituted $C_1$ to $C_{22}$ alkyl group, preferably hydrogen or a $C_1$ to $C_{16}$ alkyl group, preferably hydrogen or a $C_1$ to $C_{10}$ alkyl group, more preferably hydrogen $C_1$ to $C_4$ alkyl group. Preferably $R^5$ is hydrogen and $R^6$ is hydrogen or a $C_1$ to $C_4$ alkyl group. Most preferably $R^5$ and $R^6$ are both hydrogen. Preferably R is an aryl group substituted with one or more groups selected from hydroxyl, carboalkoxy, nitro, cyano and $NH_2$. R may be a poly-substituted aryl group, for example trihydroxyphenyl. Preferably R is a mono-substituted aryl group. Preferably R is an ortho substituted aryl group. Suitably R is substituted with a group selected from OH, $NH_2$, $NO_2$ or COOMe. Preferably R is substituted with an OH or $NH_2$ group. Suitably R is a hydroxy substituted aryl group. Most preferably R is a 2-hydroxyphenyl group.

Preferably $R^1$ is an alkyl or alkylaryl group. $R^1$ may be a $C_1$ to $C_{16}$ alkyl group, preferably a $C_1$ to $C_{10}$ alkyl group, suitably a $C_1$ to $C_8$ alkyl group. $R^1$ may be $C_1$ to $C_{16}$ alkylaryl group, preferably a $C_1$ to $C_{10}$ alkylgroup, suitably a $C_1$ to $C_8$ alkylaryl group. $R^1$ may be methyl, ethyl, propyl, butyl, pentyl, benzyl or an isomer thereof. Preferably $R^1$ is benzyl or methyl. Most preferably $R^1$ is methyl.

An especially preferred compound of formula (III) is methyl salicylate.

In some embodiments the compound of formula (III) is an ester of an α-hydroxycarboxylic acid.

In such embodiments the compound of formula (III) has the structure:

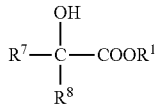

wherein $R^7$ and $R^8$ are the same or different and each is selected from hydrogen, alkyl, alkenyl, aralkyl or aryl. Compounds of this type suitable for use herein are described in EP 1254889.

Examples of compounds of formula (III) in which RCOO is the residue of an α-hydroxycarboxylic acid include methyl-, ethyl-, propyl-, butyl-, pentyl-, hexyl-, benzyl-, phenyl-, and allyl esters of 2-hydroxyisobutyric acid; methyl-, ethyl-, propyl-, butyl-, pentyl-, hexyl-, benzyl-, phenyl-, and allyl esters of 2-hydroxy-2-methylbutyric acid; methyl-, ethyl-, propyl-, butyl-, pentyl-, hexyl-, benzyl-, phenyl-, and allyl esters of 2-hydroxy-2-ethylbutyric acid; methyl-, ethyl-, propyl-, butyl-, pentyl-, hexyl-, benzyl-, phenyl-, and allyl esters of lactic acid; and methyl-, ethyl-, propyl-, butyl-, pentyl-, hexyl-, allyl-, benzyl-, and phenyl esters of glycolic acid. Of the above, a preferred compound is methyl 2-hydroxyisobutyrate.

In some embodiments the compound of formula (III) is an ester of a polycarboxylic acid. In this definition we mean to include dicarboxylic acids and carboxylic acids having more than 2 acidic moieties. In such embodiments RCOO is preferably present in the form of an ester, that is the one or more further acid groups present in the group R are in esterified form. Preferred esters are $C_1$ to $C_4$ alkyl esters.

Compound (III) may be selected from the diester of oxalic acid, the diester of phthalic acid, the diester of maleic acid, the diester of malonic acid or the diester of citric acid. One especially preferred compound of formula (III) is dimethyl oxalate.

In preferred embodiments the compound of formula (III) is an ester of a carboxylic acid having a $pK_a$ of less than 3.5. In such embodiments in which the compound includes more than one acid group, we mean to refer to the first dissociation constant.

Compound (III) may be selected from an ester of a carboxylic acid selected from one or more of oxalic acid, phthalic acid, salicylic acid, maleic acid, malonic acid, citric acid, nitrobenzoic acid, aminobenzoic acid and 2,4,6-trihydroxybenzoic acid.

Preferred compounds of formula (III) include dimethyl oxalate, methyl 2-nitrobenzoate and methyl salicylate.

An especially preferred quaternary ammonium salt for use herein is formed by reacting methyl 2-hydroxybenzoate or styrene oxide with the reaction product of a polyisobutylene-substituted succinic anhydride having a PIB molecular weight of 700 to 1000 and dimethylaminopropylamine.

The diesel fuel composition used in the method of the present invention comprises a detergent additive which is not a quaternary ammonium salt or a Mannich reaction product. The detergent additive is not a quaternary ammonium salt as defined herein. The detergent additive is not the product of a Mannich reaction between an aldehyde, an amine and an optionally substituted phenol.

Preferably the detergent additive is selected from one or more of:

(a) the reaction product of a carboxylic acid-derived acylating agent and an amine;
(b) the reaction product of a carboxylic acid-derived acylating agent and hydrazine;
(c) a salt formed by the reaction of a carboxylic acid with di-n-butylamine or tri-n-butylamine;
(d) the reaction product of a hydrocarbyl-substituted dicarboxylic acid or anhydride and an amine compound or salt which product comprises at least one amino triazole group; and
(e) a substituted polyaromatic detergent additive.

When the detergent additive comprises component (a) it is preferably formed by the reaction of an acylating agent having a hydrocarbyl substituent of at least 8 carbon atoms and a compound comprising at least one primary or secondary amine group. The acylating agent may be a mono- or polycarboxylic acid (or reactive equivalent thereof) for example a substituted succinic, phthalic or propionic acid and the amino compound may be a polyamine or a mixture of polyamines, for example a mixture of ethylene polyamines. Alternatively the amine may be a hydroxyalkyl-substituted polyamine. The hydrocarbyl substituent in such acylating agents is preferably as defined herein in relation to the nitrogen containing species (i) of the quaternary salts.

Amino compounds useful for reaction with these acylating agents include the following:

(1) polyalkylene polyamines of the general formula:

$$(R^3)_2N[U—N(R^3)]_nR^3$$

wherein each $R^3$ is independently selected from a hydrogen atom, a hydrocarbyl group or a hydroxy-substituted hydrocarbyl group containing up to about 30 carbon atoms, with proviso that at least one $R^3$ is a hydrogen atom, n is a whole number from 1 to 10 and U is a C1-18 alkylene group. Preferably each $R^3$ is independently selected from hydrogen, methyl, ethyl, propyl, isopropyl, butyl and isomers thereof. Most preferably each $R^3$ is ethyl or hydrogen. U is preferably a C1-4 alkylene group, most preferably ethylene.

(2) heterocyclic-substituted polyamines including hydroxyalkyl-substituted polyamines wherein the polyamines are as described above and the heterocyclic substituent is selected from nitrogen-containing aliphatic and aromatic heterocycles, for example piperazines, imidazolines, pyrimidines, morpholines, etc.

(3) aromatic polyamines of the general formula:

$$Ar(NR^3{}_2)_y$$

wherein Ar is an aromatic nucleus of 6 to 20 carbon atoms, each $R^3$ is as defined above and y is from 2 to 8.

Specific examples of polyalkylene polyamines (1) include ethylenediamine, diethylenetriamine, triethylenetetramine, tetraethylenepentamine, tri(tri-methylene)tetramine, pentaethylenehexamine, hexaethylene-heptamine, 1,2-propylenediamine, and other commercially available materials which comprise complex mixtures of polyamines. For example, higher ethylene polyamines optionally containing all or some of the above in addition to higher boiling fractions containing 8 or more nitrogen atoms etc. Specific examples of hydroxyalkyl-substituted polyamines include N-(2-hydroxyethyl) ethylene diamine, N,N'-bis(2-hydroxyethyl) ethylene diamine, N-(3-hydroxybutyl) tetramethylene diamine, etc. Specific examples of the heterocyclic-substituted polyamines (2) are N-2-aminoethyl piperazine, N-2 and N-3 amino propyl morpholine, N-3(dimethyl amino) propyl piperazine, 2-heptyl-3-(2-aminopropyl) imidazoline, 1,4-bis (2-aminoethyl) piperazine, 1-(2-hydroxy ethyl) piperazine, and 2-heptadecyl-1-(2-hydroxyethyl)-imidazoline, etc. Specific examples of the aromatic polyamines (3) are the various isomeric phenylene diamines, the various isomeric naphthalene diamines, etc.

Many patents have described useful acylated nitrogen compounds including U.S. Pat. Nos. 3,172,892; 3,219,666; 3,272,746; 3,310,492; 3,341,542; 3,444,170; 3,455,831; 3,455,832; 3,576,743; 3,630,904; 3,632,511; 3,804,763, 4,234,435 and 6,821,307.

One preferred detergent additive of this class is that made by reacting a poly(isobutene)-substituted succinic acid-derived acylating agent (e.g., anhydride, acid, ester, etc.) wherein the poly(isobutene) substituent has between about 12 to about 200 carbon atoms with a mixture of ethylene polyamines having 3 to about 9 amino nitrogen atoms per ethylene polyamine and about 1 to about 8 ethylene groups. These acylated nitrogen compounds are formed by the reaction of a molar ratio of acylating agent:amino compound of from 10:1 to 1:10, preferably from 5:1 to 1:5, more preferably from 2:1 to 1:2 and most preferably from 2:1 to 1:1. In especially preferred embodiments, the acylated nitrogen compounds are formed by the reaction of acylating agent to amino compound in a molar ratio of from 1.8:1 to 1:1.2, preferably from 1.6:1 to 1:1.2, more preferably from 1.4:1 to 1:1.1 and most preferably from 1.2:1 to 1:1. This type of acylated amino compound and the preparation thereof is well known to those skilled in the art and are described in the above-referenced US patents.

A further preferred acylated nitrogen compound is one formed by the reaction of a succinic acid-derived acylating agent having a C1 to C20 alkyl substituent with an amine. In such embodiments, the succinic acid acylating agent is preferably substituted with C8 to C16 substituent, most preferably a C12 substituent. This is preferably reacted with a polyalkylene polyamine as described above or especially hydrazine. The ratio of acylating agent to the amine is preferably from 2:1 to 1:1.

Another type of detergent additive belonging to this class is that made by reacting the afore-described alkylene amines with the afore-described substituted succinic acids or anhydrides and aliphatic mono-carboxylic acids having from 2 to about 22 carbon atoms. In these types of acylated nitrogen compounds, the mole ratio of succinic acid to mono-carboxylic acid ranges from about 1:0.1 to about 1:1. Typical of the monocarboxylic acid are formic acid, acetic acid, dodecanoic acid, butanoic acid, oleic acid, stearic acid, the commercial mixture of stearic acid isomers known as isostearic acid, tolyl acid, etc. Such materials are more fully described in U.S. Pat. Nos. 3,216,936 and 3,250,715.

A further type of detergent additive belonging to this class suitable for use in the present invention is the product of the reaction of a fatty monocarboxylic acid of about 12-30 carbon atoms and the afore-described alkylene amines, typically, ethylene, propylene or trimethylene polyamines containing 2 to 8 amino groups and mixtures thereof. The fatty mono-carboxylic acids are generally mixtures of straight and branched chain fatty carboxylic acids containing 12-30 carbon atoms. Fatty dicarboxylic acids could also be used. A widely used type of acylated nitrogen compound is made by reacting the afore-described alkylene polyamines with a mixture of fatty acids having from 5 to about 30 mole percent straight chain acid and about 70 to about 95 percent mole branched chain fatty acids. Among the commercially available mixtures are those known widely in the trade as isostearic acid. These mixtures are produced as a by-product from the dimerization of unsaturated fatty acids as described in U.S. Pat. Nos. 2,812,342 and 3,260,671.

The branched chain fatty acids can also include those in which the branch may not be alkyl in nature, for example phenyl and cyclohexyl stearic acid and the chloro-stearic acids. Branched chain fatty carboxylic acid/alkylene polyamine products have been described extensively in the art. See for example, U.S. Pat. Nos. 3,110,673; 3,251,853; 3,326,801; 3,337,459; 3,405,064; 3,429,674; 3,468,639; 3,857,791. These patents are referenced for their disclosure of fatty acid/polyamine condensates for their use in lubricating oil formulations.

In some preferred embodiments the composition comprises a detergent of the type formed by the reaction of a polyisobutene-substituted succinic acid-derived acylating agent and a polyethylene polyamine. Suitable compounds are, for example, described in WO2009/040583.

Preferred nitrogen-containing detergents comprising component (a) for use herein include: the compound formed by reacting a polyisobutylene succinic anhydride (PIBSA) having a PIB molecular weight of 900 to 1100, for example approximately 1000, with aminoethyl ethanolamine or triethylene tetramine; and the compound formed by reacting a PIBSA having a PIB molecular weight of 650 to 850, for example about 750 with tetraethylene pentamine. In each case the ratio of PIBSA to amine is from 1.5:1 to 0.9:1, preferably from 1.2:1 to 1:1.

When the detergent additive comprises component (b) it may suitably comprise an additive comprising the reaction product between a hydrocarbyl-substituted succinic acid or anhydride and hydrazine.

Preferably, the hydrocarbyl group of the hydrocarbyl-substituted succinic acid or anhydride comprises a $C_8$-$C_{36}$ group, preferably a $C_8$-$C_{18}$ group. Non-limiting examples include dodecyl, hexadecyl and octadecyl. Alternatively, the hydrocarbyl group may be a polyisobutylene group with a number average molecular weight of between 200 and 2500, preferably between 800 and 1200. Mixtures of species with different length hydrocarbyl groups are also suitable, e.g. a mixture of $C_{16}$-$C_{18}$ groups.

The hydrocarbyl group is attached to a succinic acid or anhydride moiety using methods known in the art. Additionally, or alternatively, suitable hydrocarbyl-substituted succinic acids or anhydrides are commercially available e.g. dodecylsuccinic anhydride (DDSA), hexadecylsuccinic anhydride (HDSA), octadecylsuccinic anhydride (ODSA) and polyisobutylsuccinic anhydride (PIBSA).

Hydrazine has the formula $NH_2$—$NH_2$. Hydrazine may be hydrated or non-hydrated. Hydrazine monohydrate is preferred.

The reaction between the hydrocarbyl-substituted succinic acid or anhydride and hydrazine produces a variety of products, such as is disclosed in EP 1887074. It is believed to be preferable for good detergency that the reaction product contains a significant proportion of species with relatively high molecular weight. It is believed—without the matter having been definitively determined yet, to the best of our knowledge—that a major high molecular weight product of the reaction is an oligomeric species predominantly of the structure:

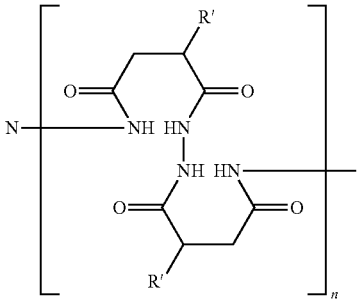

where n is an integer and greater than 1, preferably between 2 and 10, more preferably between 2 and 7, for example 3, 4 or 5. Each end of the oligomer may be capped by one or more of a variety of groups. Some possible examples of these terminal groups include:

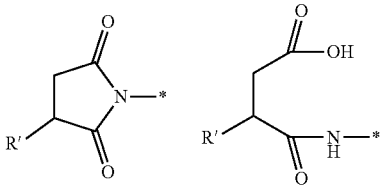

-continued

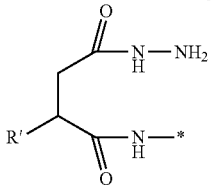

Alternatively, the oligomeric species may form a ring having no terminal groups:

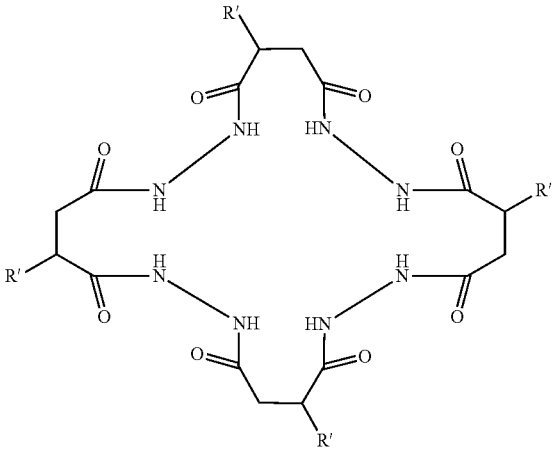

Further preferred features of embodiments in which the detergent additive comprises component (b) are as defined in EP 1887074.

When the detergent additive comprises component (c) this is suitably the di-n-butylamine or tri-n-butylamine salt of a fatty acid of the formula $[R'(COOH)_x]_y$, where each R' is a independently a hydrocarbon group of between 2 and 45 carbon atoms, and x is an integer between 1 and 4.

Preferably R' is a hydrocarbon group of 8 to 24 carbon atoms, more preferably 12 to 20 carbon atoms. Preferably, x is 1 or 2, more preferably x is 1. Preferably, y is 1, in which case the acid has a single R' group. Alternatively, the acid may be a dimer, trimer or higher oligomer acid, in which case y will be greater than 1 for example 2, 3 or 4 or more. R' is suitably an alkyl or alkenyl group which may be linear or branched. Examples of carboxylic acids which may be used in the present invention include lauric acid, myristic acid, palmitic acid, stearic acid, isostearic acid, neodecanoic acid, arachic acid, behanic acid, lignoceric acid, cerotic acid, montanic acid, melissic acid, caproleic acid, oleic acid, elaidic acid, linoleic acid, linolenic acid, coconut oil fatty acid, soy bean fatty acid, tall oil fatty acid, sunflower oil fatty acid, fish oil fatty acid, rapeseed oil fatty acid, tallow oil fatty acid and palm oil fatty acid. Mixtures of two or more acids in any proportion are also suitable. Also suitable are the anhydrides of carboxylic acids, their derivatives and mixtures thereof. In a preferred embodiment, the carboxylic acid comprises tall oil fatty acid (TOFA). It has been found that TOFA with a saturate content of less than 5% by weight is especially suitable.

Further preferred features of embodiments in which the detergent additive comprises component (c) are as defined in EP 1900795.

When the detergent additive comprises component (d) this is suitably reaction product of a hydrocarbyl substituted dicarboxylic acid or anhydride and an amine compound having the formula:

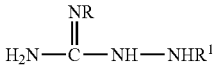

wherein R is selected from the group consisting of a hydrogen and a hydrocarbyl group containing from about 1 to about 15 carbon atoms, and $R^1$ is selected from the group consisting of hydrogen and a hydrocarbyl group containing from about 1 to about 20 carbon atoms.

Component (d) suitably comprises the reaction product of an amine compound having the formula:

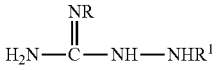

and a hydrocarbyl carbonyl compound of the formula:

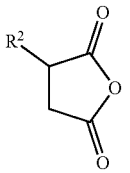

wherein $R^2$ is a hydrocarbyl group having a number average molecular weight ranging from about 100 to about 5000, preferably from 200 to 3000.

Without being bound by theory, it is believed that the reaction product of the amine and hydrocarbyl carbonyl compound is an aminotriazole, such as a bis-aminotriazole compound of the formula:

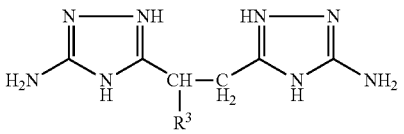

including tautomers having a number average molecular weight ranging from about 200 to about 3000 containing from about 40 to about 80 carbon atoms. The five-membered ring of the triazole is considered to be aromatic.

Examples of suitable hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of the description herein, do not alter the predominantly hydrocarbon substituent (e.g., halo (especially chloro and fluoro), hydroxy, alkoxy, mercapto, alkylmercapto, nitro, nitroso, and sulfoxy);

(3) hetero-substituents, that is, substituents which, while having a predominantly hydrocarbon character, in the context of this description, contain other than carbon in a ring or chain otherwise composed of carbon atoms. Hetero-atoms include sulfur, oxygen, nitrogen, and encompass substituents such as pyridyl, furyl, thienyl, and imidazolyl. In general, no more than two, or as a further example, no more than one, non-hydrocarbon substituent will be present for every ten carbon atoms in the hydrocarbyl group; in some embodiments, there will be no non-hydrocarbon substituent in the hydrocarbyl group.

Non-limiting examples of suitable hydrocarbyl carbonyl compounds include, but are not limited to, hydrocarbyl substituted succinic anhydrides, hydrocarbyl substituted succinic acids, and esters of hydrocarbyl substituted succinic acids. In some preferred embodiments the hydrocarbyl carbonyl compounds may comprise a polyisobutenyl-substituted succinic acid or succinic anhydride. Such compounds are suitably as described in relation to the hydrocarbyl-substituted acylating agent of the nitrogen-containing species (i) above.

Suitable amine compounds of the formula:

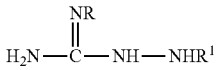

may be chosen from guanidines and aminoguanidines or salts thereof wherein R and $R^1$ are as defined above. Accordingly, the amine compound may be chosen from the inorganic salts of guanidines, such as the halide, carbonate, nitrate, phosphate, and orthophosphate salts of guanidines. The term "guanidines" refers to guanidine and guanidine derivatives, such as aminoguanidine. In one embodiment, the guanidine compound for the preparation of the additive is aminoguanidine bicarbonate. Aminoguanidine bicarbonates are readily obtainable from commercial sources, or can be prepared in a well-known manner.

Further preferred features of embodiments in which the detergent additive comprises component (d) are as defined in US2009/0282731.

When the detergent additive comprises component (e) this preferably comprises at least one compound of formula (IV) and/or formula (V):

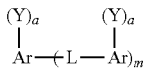

(IV)

wherein each Ar independently represents an aromatic moiety having 0 to 3 substituents selected from the group consisting of alkyl, alkoxy, alkoxyalkyl, aryloxy, aryloxyalkyl, hydroxy, hydroxyalkyl, halo and combinations thereof;

each L is independently a linking moiety comprising a carbon-carbon single bond or a linking group;

each Y is independently —$OR^{1'}$ or a moiety of the formula $H(O(CR^1{}_2)_n)_yX$—, wherein X is selected from the group consisting of $(CR^1{}_2)_2$, O and S: $R^1$ and $R^{1'}$ are each independently selected from H, $C_1$ to $C_6$ alkyl and aryl; $R^{1''}$ is selected from $C_1$ to $C_{100}$ alkyl and aryl; z is 1 to 10; n is 0 to 10 when X is $(CR^1{}_2)_2$, and 2 to 10 when X is O or S; and y is 1 to 30;

each a is independently 0 to 3, with the proviso that at least one Ar moiety bears at least one group Y; and m is 1 to 100; preferably Ar is naphthalene, y is $HOCH_2CH_2O$— and L is —$CH_2$—;

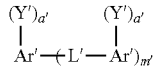

(V)

wherein each Ar independently represents an aromatic moiety having 0 to 3 substituents selected from the group consisting of alkyl, alkoxy, alkoxyalkyl, hydroxy, hydroxyalkyl, acyloxy, acyloxyalkyl, acyloxyalkoxy, aryloxy, aryloxyalkyl, aryloxyalkoxy, halo and combinations thereof;

each L' is independently a linking moiety comprising a carbon-carbon single bond or linking group;

each Y' is independently a moiety of the formula ZO— or $Z(O(CR^2{}_2)_{n'})_yX'$—, wherein X' is selected from the group consisting of $(CR^{2'}{}_2)_z$, O and S; $R^2$ and $R^{2'}$ are each independently selected from H, $C_1$ to $C_6$ alkyl and aryl z' is 1 to 10; n' is 0 to 10 when X' is $(CR^{2'}{}_2)_z$, and 2 to 10 when X' is O or S; y is 1 to 30; Z is H, an acyl group, a polyacyl group, a lactone ester group, an acid ester group, an alkyl group or an aryl group;

each a' is independently 0 to 3, with the proviso that at least one Ar' moiety bears at least one group Y' in which Z is not H; and m' is 1 to 100.

In a preferred embodiment compound of formula (V) is the reaction product of an ethoxylated naphthol and paraformaldehyde which is then reacted with a hydrocarbyl substituted acylating agent.

Further preferred features of embodiments in which the detergent additive comprises component (e) are as defined in EP 1884556.

According to a second aspect of the present invention there is provided a diesel fuel composition for use in the method of the first aspect. Preferred features of the second aspect are as defined in relation to the first aspect.

Suitable treat rates of the quaternary ammonium salt additive and the detergent additive will depend on the desired performance and on the type of engine in which they are used. For example different levels of additive may be needed to achieve different levels of performance.

Suitably the quaternary ammonium salt additive is present in the diesel fuel composition used in the method of the present invention in an amount of less than 10000 ppm, preferably less than 1000 ppm, preferably less than 500 ppm, preferably less than 250 ppm.

Suitably the detergent additive when used is present in the diesel fuel composition used in the method of the present invention in an amount of less than 10000 ppm, 1000 ppm preferably less than 500 ppm, preferably less than 250 ppm.

The weight ratio of the quaternary ammonium salt additive to the detergent additive is preferably from 1:10 to 10:1, preferably from 1:4 to 4:1.

The diesel fuel composition may comprises a mixture of one or more detergent additives and/or one or more quaternary ammonium salt additives. In embodiments in which more than one detergent additive and/or more than one quaternary ammonium salt additive is present, the above amounts and ratios refer to all additives of that particular type present in the composition.

As stated previously, fuels containing biodiesel or metals are known to cause fouling. Severe fuels, for example those containing high levels of metals and/or high levels of biodiesel may require higher treat rates of the quaternary ammonium salt additive and/or detergent additive than fuels which are less severe.

In some preferred embodiments the diesel fuel composition comprises detergent additive (a) and a quaternary ammonium salt formed from component (i).

In some preferred embodiments the diesel fuel composition comprises detergent additive (b) and a quaternary ammonium salt formed from component (i).

In some preferred embodiments the diesel fuel composition comprises detergent additive (c) and a quaternary ammonium salt formed from component (i).

In some preferred embodiments the diesel fuel composition comprises detergent additive (d) and a quaternary ammonium salt formed from component (i).

In some preferred embodiments the diesel fuel composition comprises detergent additive (e) and a quaternary ammonium salt formed from component (i).

In some preferred embodiments the diesel fuel composition comprises detergent additive (a) and a quaternary ammonium salt formed from component (ii).

In some preferred embodiments the diesel fuel composition comprises detergent additive (b) and a quaternary ammonium salt formed from component (ii).

In some preferred embodiments the diesel fuel composition comprises detergent additive (c) and a quaternary ammonium salt formed from component (ii).

In some preferred embodiments the diesel fuel composition comprises detergent additive (d) and a quaternary ammonium salt formed from component (ii).

In some preferred embodiments the diesel fuel composition comprises detergent additive (e) and a quaternary ammonium salt formed from component (ii).

In some preferred embodiments the diesel fuel composition comprises detergent additive (a) and a quaternary ammonium salt formed from component (iii).

In some preferred embodiments the diesel fuel composition comprises detergent additive (b) and a quaternary ammonium salt formed from component (iii).

In some preferred embodiments the diesel fuel composition comprises detergent additive (c) and a quaternary ammonium salt formed from component (iii).

In some preferred embodiments the diesel fuel composition comprises detergent additive (d) and a quaternary ammonium salt formed from component (iii).

In some preferred embodiments the diesel fuel composition comprises detergent additive (e) and a quaternary ammonium salt formed from component (iii).

The diesel fuel composition of the present invention may include one or more further additives such as those which are commonly found in diesel fuels. These include, for example, antioxidants, dispersants, detergents, metal deactivating compounds, wax anti-settling agents, cold flow improvers, cetane improvers, dehazers, stabilisers, demulsifiers, antifoams, corrosion inhibitors, lubricity improvers, dyes, markers, combustion improvers, metal deactivators, odour masks, drag reducers and conductivity improvers. Examples of suitable amounts of each of these types of additives will be known to the person skilled in the art.

By diesel fuel we include any fuel suitable for use in a diesel engine either for road use or non-road use. This includes but is not limited to fuels described as diesel, marine diesel, heavy fuel oil, industrial fuel oil, etc.

The diesel fuel composition of the present invention may comprise a petroleum-based fuel oil, especially a middle distillate fuel oil. Such distillate fuel oils generally boil within the range of from 110° C. to 500° C., e.g. 150° C. to 400° C. The diesel fuel may comprise atmospheric distillate or vacuum distillate, cracked gas oil, or a blend in any proportion of straight run and refinery streams such as thermally and/or catalytically cracked and hydro-cracked distillates.

The diesel fuel composition of the present invention may comprise non-renewable Fischer-Tropsch fuels such as those described as GTL (gas-to-liquid) fuels, CTL (coal-to-liquid) fuels and OTL (oil sands-to-liquid).

The diesel fuel composition of the present invention may comprise a renewable fuel such as a biofuel composition or biodiesel composition.

The diesel fuel composition may comprise 1st generation biodiesel. First generation biodiesel contains esters of, for example, vegetable oils, animal fats and used cooking fats. This form of biodiesel may be obtained by transesterification of oils, for example rapeseed oil, soybean oil, safflower oil, palm 25 oil, corn oil, peanut oil, cotton seed oil, tallow, coconut oil, physic nut oil (Jatropha), sunflower seed oil, used cooking oils, hydrogenated vegetable oils or any mixture thereof, with an alcohol, usually a monoalcohol, in the presence of a catalyst.

The diesel fuel composition may comprise second generation biodiesel. Second generation biodiesel is derived from renewable resources such as vegetable oils and animal fats and processed, often in the refinery, often using hydroprocessing such as the H-Bio process developed by Petrobras. Second generation biodiesel may be similar in properties and quality to petroleum based fuel oil streams, for example renewable diesel produced from vegetable oils, animal fats etc. and marketed by ConocoPhillips as Renewable Diesel and by Neste as NExBTL.

The diesel fuel composition of the present invention may comprise third generation biodiesel. Third generation biodiesel utilises gasification and Fischer-Tropsch technology including those described as BTL (biomass-to-liquid) fuels. Third generation biodiesel does not differ widely from some second generation biodiesel, but aims to exploit the whole plant (biomass) and thereby widens the feedstock base.

The diesel fuel composition may contain blends of any or all of the above diesel fuel compositions.

In some embodiments the diesel fuel composition of the present invention may be a blended diesel fuel comprising bio-diesel. In such blends the bio-diesel may be present in an amount of, for example up to 0.5%, up to 1%, up to 2%, up to 3%, up to 4%, up to 5%, up to 10%, up to 20%, up to 30%, up to 40%, up to 50%, up to 60%, up to 70%, up to 80%, up to 90%, up to 95% or up to 99%.

In some embodiments the diesel fuel composition may comprise a secondary fuel, for example ethanol. Preferably however the diesel fuel composition does not contain ethanol.

The diesel fuel composition of the present invention may contain a relatively high sulphur content, for example greater than 0.05% by weight, such as 0.1% or 0.2%.

However in preferred embodiments the diesel fuel has a sulphur content of at most 0.05% by weight, more preferably of at most 0.035% by weight, especially of at most 0.015%. Fuels with even lower levels of sulphur are also suitable such as, fuels with less than 50 ppm sulphur by weight, preferably less than 20 ppm, for example 10 ppm or less.

Commonly when present, metal-containing species will be present as a contaminant, for example through the corrosion of metal and metal oxide surfaces by acidic species present in the fuel or from lubricating oil. In use, fuels such as diesel fuels routinely come into contact with metal surfaces for example, in vehicle fuelling systems, fuel tanks, fuel transportation means etc. Typically, metal-containing contamination may comprise transition metals such as zinc, iron and copper; group I or group II metals such as sodium; and other metals such as lead.

In addition to metal-containing contamination which may be present in diesel fuels there are circumstances where metal-containing species may deliberately be added to the fuel. For example, as is known in the art, metal-containing fuel-borne catalyst species may be added to aid with the regeneration of particulate traps. Such catalysts are often based on metals such as iron, cerium, Group I and Group II metals e.g., calcium and strontium, either as mixtures or alone. Also used are platinum and manganese. The presence of such catalysts may also give rise to injector deposits when the fuels are used in diesel engines having high pressure fuel systems.

Metal-containing contamination, depending on its source, may be in the form of insoluble particulates or soluble compounds or complexes. Metal-containing fuel-borne catalysts are often soluble compounds or complexes or colloidal species.

In some embodiments, the metal-containing species comprises a fuel-borne catalyst.

In some embodiments, the metal-containing species comprises zinc.

Typically, the amount of metal-containing species in the diesel fuel, expressed in terms of the total weight of metal in the species, is between 0.1 and 50 ppm by weight, for example between 0.1 and 10 ppm by weight, based on the weight of the diesel fuel.

According to a third aspect the present invention may also provide an additive composition which upon addition to a diesel fuel provides a composition of the second aspect. Preferred features of the third aspect are as defined in relation to the first and second aspects.

The first aspect of the present invention relates to a method of reducing deposits in a diesel engine. Reducing deposits may involve reducing or the preventing of the formation of deposits in a diesel engine compared to when running the engine using unadditised fuel. Such a method may be regarded as achieving "keep clean" performance.

Reducing deposits may involve the removal of existing deposits in a diesel engine. This may be regarded as achieving "clean up" performance.

In especially preferred embodiments the method of the first aspect of the present invention and the diesel fuel composition of the second aspect may be used to provide "keep clean" and "clean up" performance.

In some preferred embodiments the method of the present invention involves reducing deposits in a diesel engine having a high pressure fuel system.

Modern diesel engines having a high pressure fuel system may be characterised in a number of ways. Such engines are typically equipped with fuel injectors having a plurality of apertures, each aperture having an inlet and an outlet.

Such modern diesel engines may be characterised by apertures which are tapered such that the inlet diameter of the spray-holes is greater than the outlet diameter.

Such modern engines may be characterised by apertures having an outlet diameter of less than 500 μm, preferably less than 200 μm, more preferably less than 150 μm, preferably less than 100 μm, most preferably less than 80 μm or less.

Such modern diesel engines may be characterised by apertures where an inner edge of the inlet is rounded.

Such modern diesel engines may be characterised by the injector having more than one aperture, suitably more than 2 apertures, preferably more than 4 apertures, for example 6 or more apertures.

Such modern diesel engines may be characterised by an operating tip temperature in excess of 250° C.

Such modern diesel engines may be characterised by a fuel pressure of more than 1350 bar, preferably more than 1500 bar, more preferably more than 2000 bar.

The method of the present invention is preferably carried out in an engine having one or more of the above-described characteristics.

The present invention is particularly useful in reducing (deposits on injectors of engines operating at high pressures and temperatures in which fuel may be recirculated and which comprise a plurality of fine apertures through which the fuel is delivered to the engine. The present invention finds utility in engines for heavy duty vehicles and passenger vehicles. Passenger vehicles incorporating a high speed direct injection (or HSDI) engine may for example benefit from the present invention.

Within the injector body of modern diesel engines having a high pressure fuel system, clearances of only 1-2 μm may exist between moving parts and there have been reports of engine problems in the field caused by injectors sticking and particularly injectors sticking open. Control of deposits in this area can be very important.

According to a fourth aspect of the present invention there is provided the use in a diesel fuel composition of the combination of a detergent additive which is not a quaternary ammonium salt or a Mannich reaction product and a quaternary ammonium salt additive comprising the reaction product of nitrogen containing species having at least one tertiary amine group and a quaternizing agent to improve the performance of a diesel engine when using said diesel fuel composition; wherein the nitrogen containing species is selected from:

(i) the reaction product of a hydrocarbyl-substituted acylating agent and a compound comprising at least one tertiary amine group and a primary amine, secondary amine or alcohol group;

(ii) a Mannich reaction product comprising a tertiary amine group; and (iii) a polyalkylene substituted amine having at least one tertiary amine group.

Preferred features of the fourth aspect are as defined in relation to the first, second and third aspects.

Thus as described above the diesel fuel compositions of the present invention may be used to improve the performance of modern diesel engines having high pressure fuel systems. The diesel fuel compositions of the present invention may also provide improved performance when used with traditional diesel engines. Preferably the improved performance is achieved when using the diesel fuel compositions in modern diesel engines having high pressure fuel systems and when using the compositions in traditional diesel engines. This is important because it allows a single fuel to be provided that can be used in new engines and older vehicles.

The improvement in performance of the diesel engine system may be measured by a number of ways. Suitable methods will depend on the type of engine and whether "keep clean" and/or "clean up" performance is measured.

One of the ways in which the improvement in performance can be measured is by measuring the power loss in a controlled engine test. An improvement in "keep clean" performance may be measured by observing a reduction in power loss compared to that seen in a base fuel. "Clean up" performance can be observed by an increase in power when diesel fuel compositions of the invention are used in an already fouled engine.

The improvement in performance of the diesel engine having a high pressure fuel system may be measured by an improvement in fuel economy.

The use of the fourth aspect may also improve the performance of the engine by reducing deposits in the vehicle fuel filter. This may be a reduction or prevention of the formation of deposits or the removal of existing deposits.

The level of deposits in a vehicle fuel filter may be measured quantitatively or qualitatively. In some cases this may only be determined by inspection of the filter once the filter has been removed. In other cases, the level of deposits may be estimated during use.

Many vehicles are fitted with a fuel filter which may be visually inspected during use to determine the level of solids build up and the need for filter replacement. For example, one such system uses a filter canister within a transparent housing allowing the filter, the fuel level within the filter and the degree of filter blocking to be observed.

Using the fuel compositions of the present invention may result in levels of deposits in the fuel filter which are considerably reduced compared with fuel compositions not of the present invention. This allows the filter to be changed much less frequently and can ensure that fuel filters do not fail between service intervals. Thus the use of the compositions of the present invention may lead to reduced maintenance costs.

In some embodiments the occurrence of deposits in a fuel filter may be inhibited or reduced. Thus a "keep clean" performance may be observed. In some embodiments existing deposits may be removed from a fuel filter. Thus a "clean up" performance may be observed.

Improvement in performance may also be assessed by considering the extent to which the use of the fuel compositions of the invention reduce the amount of deposit on the injector of an engine. For "keep clean" performance a reduction in occurrence of deposits would be observed. For "clean up" performance removal of existing deposits would be observed.

Direct measurement of deposit build up is not usually undertaken, but is usually inferred from the power loss or fuel flow rates through the injector.

The use of the fourth aspect may improve the performance of the engine by reducing, preventing or removing deposits including gums and lacquers within the injector body.

In Europe the Co-ordinating European Council for the development of performance tests for transportation fuels, lubricants and other fluids (the industry body known as CEC), has developed a new test, named CEC F-98-08, to assess whether diesel fuel is suitable for use in engines meeting new European Union emissions regulations known as the "Euro 5" regulations. The test is based on a Peugeot DW10 engine using Euro 5 injectors, and will hereinafter be referred to as the DW10 test. This test is described in example 1.

Preferably the use of the fuel composition of the present invention leads to reduced deposits in the DW10 test. For "keep clean" performance a reduction in the occurrence of deposits is preferably observed. For "clean up" performance removal of deposits is preferably observed. The DW10 test is used to measure the power loss in modern diesel engines having a high pressure fuel system.

For older engines an improvement in performance may be measured using the XUD9 test. This test is described in example 2.

Suitably the method of the present invention may provide a "keep clean" performance in modern diesel engines, that is the formation of deposits on the injectors of these engines may be inhibited or prevented. Preferably this performance is such that a power loss of less than 5%, preferably less than 2% is observed after 32 hours as measured by the DW10 test.

Suitably the method of the present invention may provide a "clean up" performance in modern diesel engines, that is deposits on the injectors of an already fouled engine may be removed. Preferably this performance is such that the power of a fouled engine may be returned to within 1% of the level achieved when using clean injectors within 8 hours as measured in the DW10 test.

Preferably rapid "clean-up" may be achieved in which the power is returned to within 1% of the level observed using clean injectors within 4 hours, preferably within 2 hours.

Clean injectors can include new injectors or injectors which have been removed and physically cleaned, for example in an ultrasound bath.

Suitably the method the present invention may provide a "keep clean" performance in traditional diesel engines, that is the formation of deposits on the injectors of these engines may be inhibited or prevented. Preferably this performance is such that a flow loss of less than 50%, preferably less than 30% is observed after 10 hours as measured by the XUD-9 test.

Suitably the method of the present invention may provide a "clean up" performance in traditional diesel engines, that is deposits on the injectors of an already fouled engine may be removed. Preferably this performance is such that the flow loss of a fouled engine may be increased by 10% or more within 10 hours as measured in the XUD-9 test.

Any feature of any aspect of the invention may be combined with any other feature, where appropriate.

EXAMPLE 1

The performance of fuel compositions of the present invention in modern engines may be tested according to the CECF-98-08 DW 10 method.

The engine of the injector fouling test is the PSA DW10BTED4. In summary, the engine characteristics are:

- Design: Four cylinders in line, overhead camshaft, turbocharged with EGR
- Capacity: 1998 $cm^3$
- Combustion chamber: Four valves, bowl in piston, wall guided direct injection
- Power: 100 kW at 4000 rpm
- Torque: 320 Nm at 2000 rpm
- Injection system: Common rail with piezo electronically controlled 6-hole injectors.
- Max. pressure: 1600 bar ($1.6\times10^8$ Pa). Proprietary design by SIEMENS VDO
- Emissions control: Conforms with Euro IV limit values when combined with exhaust gas post-treatment system (DPF)

This engine was chosen as a design representative of the modern European high-speed direct injection diesel engine capable of conforming to present and future European emissions requirements. The common rail injection system uses a highly efficient nozzle design with rounded inlet edges and conical spray holes for optimal hydraulic flow. This type of nozzle, when combined with high fuel pressure has allowed advances to be achieved in combustion efficiency, reduced noise and reduced fuel consumption, but are sensitive to influences that can disturb the fuel flow, such as deposit formation in the spray holes. The presence of these deposits causes a significant loss of engine power and increased raw emissions.

The test is run with a future injector design representative of anticipated Euro V injector technology.

It is considered necessary to establish a reliable baseline of injector condition before beginning fouling tests, so a sixteen hour running-in schedule for the test injectors is specified, using non-fouling reference fuel.

Full details of the CEC F-98-08 test method can be obtained from the CEC. The coking cycle is summarised below.

1. A warm up cycle (12 minutes) according to the following regime:

| Step | Duration (minutes) | Engine Speed (rpm) | Torque (Nm) |
|---|---|---|---|
| 1 | 2 | idle | <5 |
| 2 | 3 | 2000 | 50 |
| 3 | 4 | 3500 | 75 |
| 4 | 3 | 4000 | 100 |

2. 8 hrs of engine operation consisting of 8 repeats of the following cycle

| Step | Duration (minutes) | Engine Speed (rpm) | Load (%) | Torque (Nm) | Boost Air After IC (° C.) |
|---|---|---|---|---|---|
| 1 | 2 | 1750 | (20) | 62 | 45 |
| 2 | 7 | 3000 | (60) | 173 | 50 |
| 3 | 2 | 1750 | (20) | 62 | 45 |
| 4 | 7 | 3500 | (80) | 212 | 50 |
| 5 | 2 | 1750 | (20) | 62 | 45 |
| 6 | 10 | 4000 | 100 | * | 50 |
| 7 | 2 | 1250 | (10) | 20 | 43 |
| 8 | 7 | 3000 | 100 | * | 50 |
| 9 | 2 | 1250 | (10) | 20 | 43 |
| 10 | 10 | 2000 | 100 | * | 50 |
| 11 | 2 | 1250 | (10) | 20 | 43 |
| 12 | 7 | 4000 | 100 | * | 50 |

* for expected range see CEC method CEC-F-98-08

3. Cool down to idle in 60 seconds and idle for 10 seconds
4. 4 hrs soak period

The standard CEC F-98-08 test method consists of 32 hours engine operation corresponding to 4 repeats of steps 1-3 above, and 3 repeats of step 4. ie 56 hours total test time excluding warm ups and cool downs.

EXAMPLE 2

The performance of fuel compositions of the present invention in older engine types may be assessed using a standard industry test—CEC test method No. CEC F-23-A-01.

This test measures injector nozzle coking using a Peugeot XUD9 A/L Engine and provides a means of discriminating between fuels of different injector nozzle coking propensity. Nozzle coking is the result of carbon deposits forming between the injector needle and the needle seat. Deposition of the carbon deposit is due to exposure of the injector needle and seat to combustion gases, potentially causing undesirable variations in engine performance.

The Peugeot XUD9 A/L engine is a 4 cylinder indirect injection Diesel engine of 1.9 litre swept volume, obtained from Peugeot Citroen Motors specifically for the CEC PF023 method.

The test engine is fitted with cleaned injectors utilising unflatted injector needles. The airflow at various needle lift positions have been measured on a flow rig prior to test. The engine is operated for a period of 10 hours under cyclic conditions.

| Stage | Time (secs) | Speed (rpm) | Torque (Nm) |
|---|---|---|---|
| 1 | 30 | 1200 ± 30 | 10 ± 2 |
| 2 | 60 | 3000 ± 30 | 50 ± 2 |
| 3 | 60 | 1300 ± 30 | 35 ± 2 |
| 4 | 120 | 1850 ± 30 | 50 ± 2 |

The propensity of the fuel to promote deposit formation on the fuel injectors is determined by measuring the injector nozzle airflow again at the end of test, and comparing these values to those before test. The results are expressed in terms of percentage airflow reduction at various needle lift positions for all nozzles. The average value of the airflow reduction at 0.1 mm needle lift of all four nozzles is deemed the level of injector coking for a given fuel.

EXAMPLE 3

Additive A1 is a 60% active ingredient solution (in aromatic solvent) of a polyisobutenyl succinimide obtained from the condensation reaction of a polyisobutenyl succinic anhydride (PIBSA) derived from polyisobutene of Mn approximately 1000 with a polyethylene polyamine mixture of average composition approximating to triethylene tetramine. The product was obtained by mixing the PIBSA and polyethylene polyamine at 50° C. under nitrogen and heating at 160° C. for 5 hours with removal of water.

EXAMPLE 4

Additive A2 is a 60% active ingredient solution (in aromatic solvent) of a polyisobutenyl succinimide obtained from the condensation reaction of a polyisobutenyl succinic anhydride derived from polyisobutene of Mn approximately 750 with a polyethylene polyamine mixture of average composition approximating to tetraethylene pentamine. The product was obtained by mixing the PIBSA and polyethylene polyamine at 50° C. under nitrogen and heating at 160° C. for 5 hours with removal of water.

EXAMPLE 5

Additive B1 was prepared as follows:

200 g of Dodecylsuccinic anhydride (0.75 mol) and 200 g toluene were added to a vessel and stirred under nitrogen. The temperature was raised to 50° C. and hydrazine monohydrate (112.8 g, 2.25 mol) added dropwise. Once addition was complete, the mixture was heated to reflux for 5 hours. Toluene was removed at 40° C. until no more bubbling was observed and then the product was held for 4 hours under vacuum at 180° C.

EXAMPLE 6

Additive C1 was prepared as follows:

50 g of rape seed oil fatty acid (ROFA) (173 mmoles) and 22.4 g Di-n-butylamine (173 mmoles) were mixed with stirring. An exotherm was observed. FTIR analysis of the reaction product indicated that a salt had formed: there was a reduction in the strong carboxylic acid peak at 1710 $cm^{-1}$ compared to the starting acid, and carboxylate antisymmetric and symmetric stretches at 1553 and 1399 $cm^{-1}$ appeared as well a broad range of peaks 2300-2600 $cm^{-1}$ assignable to ammonium species.

EXAMPLE 7

Additive D1 was prepared as follows:

A reactor was charged with 250.6 g (0.203 mol) PIBSA (made from 1000 MW PIB reacted with maleic anhydride), 251.1 g caromax 20 and 56.0 g toluene. The mixture was heated to 95° C. and 55.2 g (0.406 mol) aminoguanidine bicarbonate added slowly over 1 hour. The temperature was increased to 165° C. and held for 3 hours to remove water. Toluene was removed under vacuum.

EXAMPLE 8

Additive Q1, a quaternary ammonium salt additive was prepared as follows:

33.9 kg (27.3 moles) of a polyisobutyl-substituted succinic anhydride having a PIB molecular weight of 1000 was heated to 90° C. 2.79 kg (27.3 moles) dimethylaminopropylamine was added and the mixture stirred at 90 to 100° C. for 1 hour. The temperature was increased to 140° C. for 3 hours with concurrent removal of water. 25 kg of 2-ethyl hexanol was added, followed by 4.15 kg methyl salicylate (27.3 moles) and the mixture maintained at 140° C. for 9.5 hours.

EXAMPLE 9

Additive Q2, a quaternary ammonium salt was prepared as follows:

A reactor was charged with 687.0 g (0.312 mol) PIBSI (made from 1000 MW PIB reacted with maleic anhydride, diluted in Caromax 20 then further reacted with DMAPA) and 205.99 g methanol. 35.6 ml (0.312 mol) styrene oxide and 18.64 g (0.312 mol) acetic acid were added. The mixture was heated to reflux for 5 hours. Methanol was removed under vacuum.

EXAMPLE 10

To a mixture of 1000 MW PIB-substituted phenol (300 g) in toluene (400 ml), at 50° C. was charged dimethylamine (40% solution in water, 26 g), followed by paraformaldehyde (7.2 g). The reaction was heated at 60° C. for 1 hour then to 120° C. for 4 hours with removal of water using Dean-Stark distillation. The product was cooled to below 50° C. and the toluene removed on a rotary evaporator to leave a pale orange clear viscous liquid (308.1 g).

EXAMPLE 11

Additive Q3, a quaternary ammonium salt was prepared as follows:

41.45 g (32.6 mMol) of the mannich reaction product prepared in example 10, methyl salicylate (5.00 g, 32.9 mMol) and 2-ethylhexanol (32.37 g, 41 wt % of total charge) were mixed with stirring under nitrogen and heated at 136° C. overnight. After 16 hours the reaction mixture was allowed to cool to below 80° C. and decanted, hot, to suitable storage and sample jars.

EXAMPLE 12

To a mixture of 1000 PIB-Chloride (300 g) in Xylenes (400 ml) at 50° C. was added Dimethylaminopropylamine (DMAPA, 70 g, 2.3 mole equivalents). The reaction was heated to reflux (140° C.) for 5 hours. The product was cooled to below 50° C. and Sodium Hydroxide (50% m/m, 50 g) was added and mixed for 1 hour at 50° C. The mixture was transferred to a separating funnel with water (200 ml) and the organics separated after two days. The organics were washed with further water (2×200 ml), dried over anhydrous $MgSO_4$ and filtered. The Xylenes were removed on a rotary evaporator to leave a dark brown/black viscous liquid (305.6 g).

EXAMPLE 13

Additive Q4 a quaternary ammonium salt was prepared as follows:

40.50 g (26 mMol) of the polyisobutylamine prepared in example 12, methyl salicylate (4.07 g, 26.7 mMol) and 2-ethylhexanol (29.54 g, 40 wt % of total charge) were mixed with stirring under nitrogen and heated at 140-141° C. overnight. After 16 hours the flask contents were allowed to cool to below 80° C. and decanted, hot, to suitable storage and sample jars.

EXAMPLE 14

Additive compositions F1 to F8 were prepared by mixing 50:50 ratios by weight of the crude products from examples 3-11 as identified table 1.

TABLE 1

| | Q1 | Q2 | Q3 | Q4 |
|---|---|---|---|---|
| A1 | F1 | | | |
| A2 | F2 | F4 | F7 | F8 |
| B1 | | F5 | | |
| C1 | | F6 | | |
| D1 | F3 | | | |

EXAMPLE 15

Fuel Compositions were prepared by adding 160 ppm by weight of the crude product from examples 3-12 in a common batch of RF06 basefuel.

Table 2 below shows the specification for RF06 base fuel.

TABLE 2

| Property | Units | Limits Min | Limits Max | Method |
|---|---|---|---|---|
| Cetane Number | | 52.0 | 54.0 | EN ISO 5165 |
| Density at 15° C. | $kg/m^3$ | 833 | 837 | EN ISO 3675 |
| Distillation | | | | |
| 50% v/v Point | ° C. | 245 | — | |
| 95% v/v Point | ° C. | 345 | 350 | |
| FBP | ° C. | — | 370 | |
| Flash Point | ° C. | 55 | — | EN 22719 |
| Cold Filter Plugging Point | ° C. | — | −5 | EN 116 |

TABLE 2-continued

| Property | Units | Limits Min | Limits Max | Method |
|---|---|---|---|---|
| Viscosity at 40° C. | $mm^2/sec$ | 2.3 | 3.3 | EN ISO 3104 |
| Polycyclic Aromatic Hydrocarbons | % m/m | 3.0 | 6.0 | IP 391 |
| Sulphur Content | mg/kg | — | 10 | ASTM D 5453 |
| Copper Corrosion | | — | 1 | EN ISO 2160 |
| Conradson Carbon Residue on 10% Dist. Residue | % m/m | — | 0.2 | EN ISO 10370 |
| Ash Content | % m/m | — | 0.01 | EN ISO 6245 |
| Water Content | % m/m | — | 0.02 | EN ISO 12937 |
| Neutralisation (Strong Acid) Number | mg KOH/g | — | 0.02 | ASTM D 974 |
| Oxidation Stability | mg/mL | — | 0.025 | EN ISO 12205 |
| HFRR (WSD1,4) | µm | — | 400 | CEC F-06-A-96 |
| Fatty Acid Methyl Ester | | prohibited | | |

EXAMPLE 16

Fuel compositions as detailed in table 3 were prepared by dosing quaternary ammonium salt additives of the present invention into an RF06 base fuel meeting the specification given in table 2 (example 15) above. The effectiveness of these compositions in older engine types was assessed using the CEC test method No. CEC F-23-A-01, as described in example 2.

TABLE 3

| Composition | Additive1 (ppm of crude product) | Additive2 (ppm of crude product) | XUD-9 % Average Flow Loss |
|---|---|---|---|
| | None | None | 78.5 |
| 1 | D1 (240) | | 69.0 |
| 2 | D1 (80) | Q1 (80) | 16.8 |

The invention claimed is:

1. A method of reducing deposits in a diesel engine, the method comprising:

combusting in the engine a diesel fuel composition comprising a detergent additive, which is not a quaternary ammonium salt or a Mannich reaction product, and a quaternary ammonium salt additive comprising the reaction product of nitrogen containing species having at least one tertiary amine group and an ester quaternizing agent;

wherein the nitrogen containing species is the reaction product of a hydrocarbyl-substituted acylating agent and a compound comprising at least one tertiary amine group and a primary amine, secondary amine or alcohol group;

wherein the method provides improved performance in modern diesel engines having a high pressure fuel system and in traditional diesel engines; and wherein the detergent additive is the reaction product of a carboxylic acid derived acylating agent and an amine.

2. The method according to claim 1 in which the formation of deposits is inhibited or prevented to provide a keep clean performance.

3. The method according to claim 1 in which the existing deposits are removed to provide a clean up performance.

4. The method according to claim 1 wherein the quaternizing agent is an ester of a carboxylic acid.

5. The method according to claim 1 wherein the nitrogen containing species comprises a compound formed by the reaction of a hydrocarbyl-substituted acylating agent and an amine of formula (I) or (II):

(I)

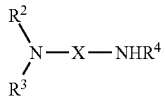

(II)

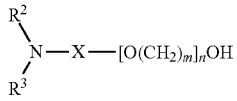

wherein $R^2$ and $R^3$ are the same or different alkyl groups having from 1 to 22 carbon atoms; X is an alkylene group having from 1 to 20 carbon atoms; n is from 0 to 20; m is from 1 to 5; and $R^4$ is hydrogen or a $C_1$ to $C_{22}$ alkyl group.

6. The method according to claim 1 wherein the quaternizing agent comprises a compound of formula (III):

(III)

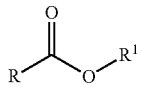

wherein R is a substituted alkyl, alkenyl, aryl or alkylaryl group; and $R^1$ is a $C_1$ to $C_{22}$ alkyl, aryl or alkylaryl group.

7. The method according to claim 1 wherein the detergent additive is made by reacting a poly(isobutene)-substituted succinic acid-derived acylating agent wherein the poly (isobutene) substituent has between about 12 to about 200 carbon atoms with a mixture of ethylene polyamines having 3 to about 9 amino nitrogen atoms per ethylene polyamine and about 1 to about 8 ethylene groups.

8. The method according to claim 1 wherein the detergent additive is the reaction product between a hydrocarbyl-substituted succinic acid or anhydride and hydrazine.

9. The method according to claim 1 wherein the quaternizing agent is selected from dimethyl oxalate, methyl 2-nitrobenzoate and methyl salicylate.

10. The method according to claim 1 wherein the diesel engine has a high pressure fuel system.

* * * * *